United States Patent [19]

Mori

[11] 4,404,538

[45] Sep. 13, 1983

[54] TEMPERATURE SWITCH INCLUDING AMORPHOUS METAL SHEET

[75] Inventor: Kojiro Mori, Okazaki, Japan

[73] Assignee: Aisin Seiki Co., Ltd., Kariya, Japan

[21] Appl. No.: 295,375

[22] Filed: Aug. 24, 1981

[30] Foreign Application Priority Data

Aug. 29, 1980 [JP] Japan ..... 55-120099

[51] Int. Cl.[3] ..... H01H 37/52

[52] U.S. Cl. ..... 337/336; 337/371; 335/146; 335/208

[58] Field of Search ..... 337/360, 347, 349, 368, 337/374, 336, 366, 371; 335/146, 208

[56] References Cited

U.S. PATENT DOCUMENTS

| | | | |
|---|---|---|---|
| 3,051,808 | 8/1962 | Reffel | 337/374 |
| 3,294,940 | 12/1966 | Ulanet | 337/374 X |
| 3,760,310 | 9/1973 | Carson | 335/146 |
| 3,943,479 | 3/1976 | Turner | 337/347 |
| 4,224,593 | 9/1980 | Hastings | 337/347 |
| 4,266,211 | 5/1981 | Ulanet | 335/208 |

FOREIGN PATENT DOCUMENTS

| | | | |
|---|---|---|---|
| 1160925 | 1/1964 | Fed. Rep. of Germany | 335/146 |

*Primary Examiner*—George Harris

*Attorney, Agent, or Firm*—Oblon, Fisher, Spivak, McClelland & Maier

[57] ABSTRACT

A temperature switch includes a housing, a movable contact mounted in the housing for movement between a first and second position, a fixed contact mounted in the housing and operatively associated with the movable contact for engagement with the movable contact in the second position, a heat sensitive plate mounted in the housing and which constitutes an amorphous metal member with a highly expansible metal wherein the amorphous metal member is exposed to a predetermined region, the temperature of which is to be determined wherein deflection of the heat sensitive plate is caused by a temperature change in the region for movement of the movable contact with respect to the fixed contact.

6 Claims, 2 Drawing Figures

TEMPERATURE SWITCH INCLUDING AMORPHOUS METAL SHEET

BACKGROUND OF THE INVENTION

Field of the Invention:

The invention relates to a temperature switch which is opened or closed in response to the temperature of a region, the temperature of which is to be determined.

SUMMARY OF THE INVENTION

The object of the present invention is to provide a temperature switch which is opened or closed in response to the temperature of a region, the temperature of which is to be determined.

In accordance with the present invention, a temperature switch utilizes a housing, a movable contact mounted in the housing for movement between a first and second position, a fixed contact mounted in the housing and operatively associated with a movable contact for engagement with the movable contact in the second position, a heat sensitive plate mounted in the housing and which includes an amorphous metal member of a highly expansible metal wherein the amorphous metal member is exposed to a predetermined region, the temperature of which is to be determined wherein deflection of the heat sensitive plate is caused by a temperature change in the region for movement of the movable contact with respect to the fixed contact.

BRIEF DESCRIPTION OF THE DRAWINGS

Various objects, features and attendant advantages of the present invention will be more fully appreciated as the same becomes better understood from the following detailed description when considered in connection with the accompanying drawings in which like reference charactes designate like or corresponding parts through the several views and wherein.

DETAILED DESCRIPTION OF THE PREFERRED EMBODIMENT

Figure 1:
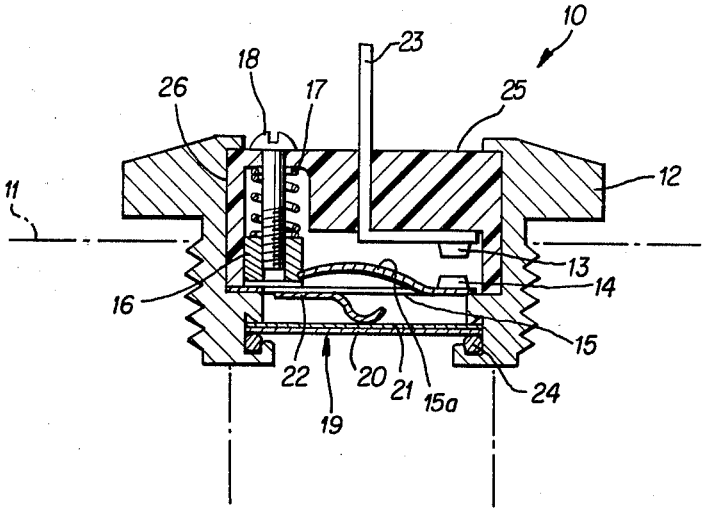
FIG. 1 is a cross sectional view of one embodiment of the present invention.

One embodiment of the invention will now be described below with reference to the drawings. A temperature switch is generally shown by reference number 10, and includes a housing 12 which may be formed of brass, for example, and which is threadably engaged with a water jacket 11 of an automobile radiator. Mounted within housing 12 is a fixed contact 13 and a leaf spring 15 fixedly carrying a movable contact 14 on one end thereof and having an opposite end secured to housing 12. A tongue 15*a* extends from one end of leaf spring 15 toward the center of housing 12, with its free end being clamped by a nut 16. Nut 16 is urged downwardly by a spring 17, and axial displacement thereof can be adjusted by an adjusting screw 18 so that the spacing between movable and fixed contact 14, 13 can be adjusted.

A heat sensitive plate 19 includes an amorphous metal sheet 20 exhibiting high corrosion resistance and a low expansion characteristic which may include 60% iron, 15% boron and 25% chromium, or 60% iron, 15% phosphorus and 25% chromium by weight proportions, and a sheet 21 of an alloy exhibiting a high expansion characteristic which may have a weight proportion of 36% nickel and 64% iron. Both sheets 20 and 21 are integrally joined together and heat sensitive plate 19 is mounted within housing 12 with the sheet 20 exposed to a path of cooling water flowing through water jacket 11, representing a region the temperature of which is to be determined.

A connection member 22 has one end thereof secured to leaf spring 15 and an opposite end engaged with sheet 21 of heat sensitive plate 19. A terminal member 23 is electrically connected with fixed contact 13 while movable contact 14 is connected to electrical ground through a path including leaf spring 15, housing 12, and water jacket 11.

A metal gasket 24 is provided to prevent ingress of the cooling water into housing 12. Packing material 25 mounted in an opening 26 in housing 12 provides electrical insulation between housing 12 on one hand and fixed contact 13 and terminal member 23 on the other and also effectively prevents ingress of water or dust into housing 12.

Figure 2:
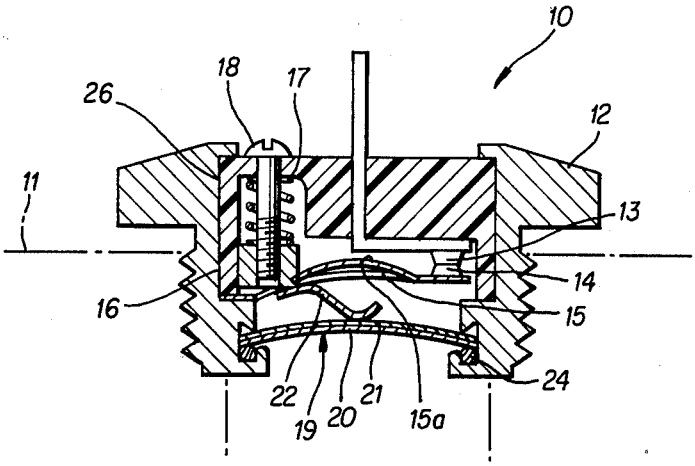
FIG. 2 is a cross sectional view illustrating the operative condition of the present invention.

In operation, when the temperature of the cooling water is low, heat sensitive plate 19 remains flat as shown in FIG. 1, with movable contact 14 removed from fixed contact 13, thus representing an open condition of the switch. As the temperature of the cooling water increases, sheet 21, which represents a component of the heat sensitive plate 19 exhibiting a high expansion, undergoes a greater magnitude of expansion than sheet 20, whereby the central region of plate 19 exhibits a deflection toward the upper side thereof as shown in FIG. 2. As a result of such deflection of heat sensitive plate 19, connection member 22 is raised upward, displacing the free end of leaf spring 15 upward against its own resilience, whereby movable contact 14 moves into abutment against fixed contact 13 to change the switch condition. Subsequently, as the temperature of the cooling water decreases, heat sensitive plate 19 returns to the condition shown in FIG. 1, and the resilience of leaf spring 15 moves movable contact 14 away from fixed contact 13, thus resuming the open condition of the switch.

It should be understood that the invention is not limited to the described embodiment in construction, but alternatively the switch may be constructed so that it changes from the closed to the open condition as a result of disengagement of the movable contact 14 from the fixed contact in response to a rise in temperature. In addition to the determination of the temperature of water in the illustrated embodiment, the temperature switch of the invention can be used with any fluid including liquid, gas and solid body so as to provide accurate switch operation in response to a temperature change of the object the temperature of which is to be determined.

As discussed above, with the arrangement of the invention, a heat sensitive plate is formed of an amorphous metal exhibiting excellent corrosion resistance and a low expansion characteristic and which is integrally joined with a metal exhibiting high expansion so as to produce a deflection in response to a temperature change, with the amorphous metal being exposed to a region the temperature of which is to be determined. The deflection of the heat sensitive plate enables switch operation. Consequently, the temperature of a given region can be accurately detected to provide switch operation, presenting great utility for practical purposes.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A water temperature switch comprising:

a housing;

a movable contact mounted in said housing for movement between a first and second position;

a fixed contact mounted in said housing and operatively associated with said movable contact for engagement with said movable contact in said second position, and heat sensitive plate means mounted in said housing and including a thin, corrosion resistant low expansible, amorphous metal sheet and a thin, highly expansible alloy sheet integrally joined together, only said amorphous metal sheet side being exposed to a predetermined water region, the temperature of which is to be determined wherein deflection of said heat sensitive plate means is caused by a temperature change in said region for a movement of said movable contact with respect to said fixed contact.

2. A water temperature switch as set forth in claim 1 further comprising:

a leaf spring mounted in said housing between said movable contact and said heat sensitive plate means; and a connecting member wherein a first end of said connecting member is connected to said leaf spring and a second end opposite said first end is connected to an electrical ground.

3. A water temperature switch as set forth in claim 1 further comprising means mounted in said housing for adjusting the space between said movable contact and said fixed contact.

4. A water temperature switch as set forth in claim 3, wherein said adjusting means comprises a nut, a spring urging said nut in a first direction, and an adjustment screw operatively engaged with said nut.

5. A water temperature switch as set forth in claim 1 further comprising:

a leaf spring mounted in said housing between said movable contact and said heat sensitive plate means;

a connecting member wherein a first end of said connecting member is connected to said leaf spring and a second end opposite said first end is connected to an electrical ground; and means mounted in said housing for adjusting the space between said movable contact and said fixed contact wherein said adjusting means comprises a nut, a spring urging said nut in a first direction and an adjustment screw operatively engaged with said nut.

6. A water temperature switch as set forth in claim 1, wherein said amorphous metal sheet of said heat sensitive plate means includes chromium for exhibiting high corrosion resistance.

* * * * *